United States Patent [19]

Johnson

[11] 4,377,046

[45] Mar. 22, 1983

[54] TAG HOLDING BRACKET

[76] Inventor: Leland R. Johnson, Box 166, Dannebrog, Nebr. 68831

[21] Appl. No.: 224,454

[22] Filed: Jan. 12, 1981

[51] Int. Cl.[3] ..... G09F 3/20

[52] U.S. Cl. ..... 40/16.4; 248/305; 248/310

[58] Field of Search ..... 40/16, 16.2, 16.4, 16.6, 40/18, 11 R, 23 R; 24/3 L, 336; 248/305, 310

[56] References Cited

U.S. PATENT DOCUMENTS 1,279,225 9/1918 Baynes ..... 40/11 R X 1,730,959 10/1929 Warfield, Jr. ..... 40/11 R 1,929,468 10/1933 Bales ..... 40/16.2

2,489,089 11/1949 Graff et al. ..... 40/16.2

*Primary Examiner*—Robert P. Swiatek

*Attorney, Agent, or Firm*—Zarley, McKee, Thomte, Voorhees & Sease

[57] ABSTRACT

A tag holding bracket includes an upright elongated base member having a support hook at its upper end and a tag receiving channel at its lower end. The rearward wall of the channel is connected to the base member and inclined forwardly from the base member so as to cause a tag supported thereon to bend about a horizontal axis. A lower portion of the base member is inclined downwardly and forwardly from an upper portion thereof for improved visibility of a tag supported on the bracket.

12 Claims, 6 Drawing Figures

TAG HOLDING BRACKET

BACKGROUND OF THE INVENTION

The present invention relates generally to a device for supporting and displaying a tag, placard or the like and more particularly to a versatile bracket adapted for support on various apparatus for displaying a tag in a position of improved visibility.

In the retail sales business, for example, it is often desirable to display a price tag, sale notice or the like on certain goods, containers or shelving to attract purchasers' attention and to provide certain information about the goods. Likewise, stacked freezer baskets of packaged meat in a slaughtering and meat processing plant are generally tagged to identify the contents in each basket. This is commonly done now with conventional cardboard tags having a wire fastener at one end. The fastening and unfastening of the wires is a rather time-consuming inconvenience and the tags must often be grasped in the hand and rotated in order to be read.

Presently available tag holding brackets are generally rather intricate or complicated little devices which are expensive to manufacture. Furthermore, these devices generally include members providing a spring grip of the tag which members can wear out in time so as to be inoperative.

Accordingly, a primary object of the present invention is to provide an improved tag holding bracket.

Another object is to provide a tag holding bracket which is simple in construction and economical to manufacture.

Another object is to provide a tag holding bracket which is effective to frictionally hold a tag in place without pinching of the tag between members biased together by spring force.

Another object is to provide a tag holding bracket which may be quickly and easily supported on a variety of types of apparatus.

Another important object of the invention is to provide a tag holding bracket which supports a tag for improved visibility.

These and other objects will be apparent from the following description.

SUMMARY OF THE INVENTION

The tag holding bracket of the present invention includes an elongated upright base member having a support hook at its upper end for suspending the bracket on an apparatus. A generally U-shaped channel or clip at the lower end of the bracket is adapted to receive a tag therein. The channel is inclined forwardly from the lower portion of the base member so that a tag supported on the bracket is at least slightly bent along a horizontal axis so that its own resilience contributes to its frictional securement in the bracket. A lower portion of the upright base member is also inclined forwardly from an upper portion of the base member so that the tag is supported at an incline to the vertical so as to be readily visible from above. The bracket of the present invention may be economically formed from a single blank of bendable flat sheet stock.

DESCRIPTION OF THE PREFERRED EMBODIMENT

Figure 1:
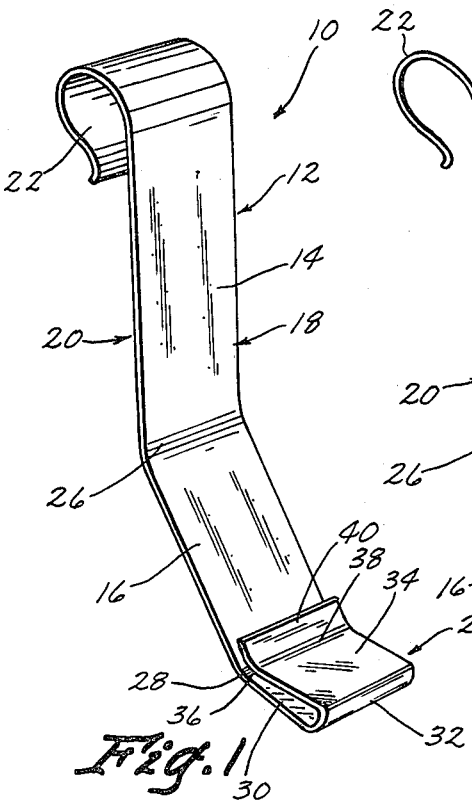
FIG. 1 is a perspective view of the bracket.

The tag holding bracket 10 of the present invention includes an elongated base member 12 having upper and lower portions 14 and 16 respectively and forward and rearward sides 18 and 20 respectively. A hook 22 is formed at the upper end of the base member 12 for suspending it from an apparatus as indicated in FIGS. 3–6. A U-shaped channel or clip 24 is provided at the lower end of base member 12 for receiving and supporting a tag, placard or the like.

In the preferred embodiment shown, upper and lower portions 14 and 16 of base member 12 are substantially flat and connected together at a first bend 26 such that lower portion 16 is inclined relative to upper portion 14 and extended downwardly and forwardly therefrom. Bend 26 is made about an axis directed transversely across the base member.

Likewise, channel 24 is connected to the lower portion 16 at a second bend 28 such that the flat rearward wall 30 of channel 24 is inclined relative to lower portion 16 and extended forwardly and downwardly therefrom. A central portion 32 of channel 24 is bent upwardly and the forward wall 34 is extended upwardly and rearwardly over rearward wall 30.

A tag engaging surface 36 is formed on the rearward side of forward wall 34 by a third bend 38 at the lower end of an end flange 40 which is directed generally parallel to lower portion 16 of base member 12.

Figure 3:
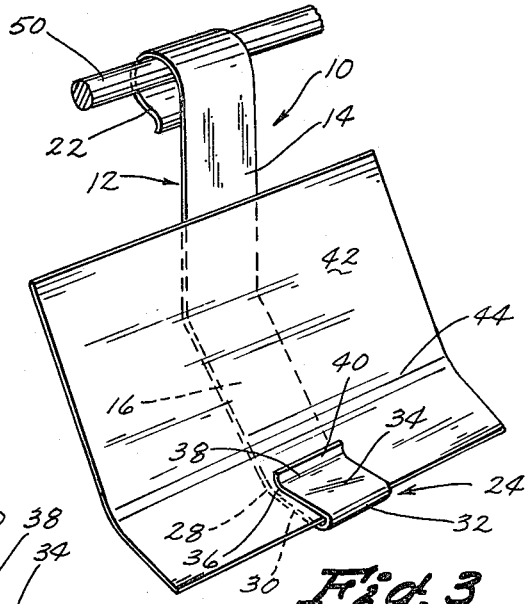
FIG. 3 is a perspective view of the bracket suspended from a wire and holding a tag.

FIG. 3 shows a tag 42 supported on bracket 10. Note that the lower edge of the tag engages the bottom or central portion 32 of channel 24 and that the second bend 28 at the lower end of base member 12 causes tag 42 to be somewhat bent as at 44 about a generally horizontal axis. Accordingly, the natural resilience of the tag material urges the forward surface of the tag against tag engaging surface 36 of channel 24 thereby contributing to the frictional securement of the tag 42 within the bracket 10.

The first bend 26 inclines the lower portion 16 of base member 12 forwardly from upper portion 14 so that a tag 42 supported on the bracket is inclined relative to the vertical so as to be easily viewed from above as well as from a position in front of the tag.

Figure 4:
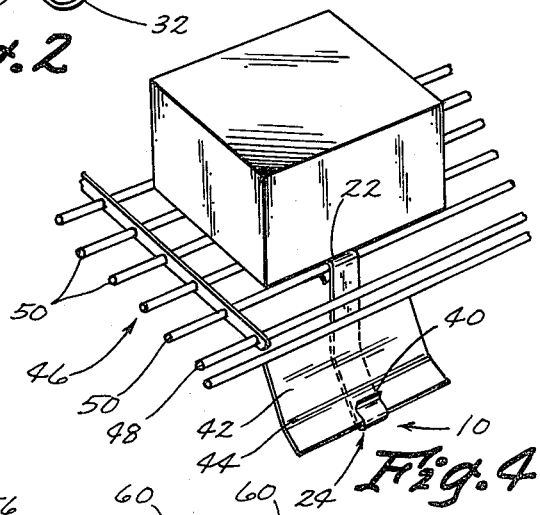
FIG. 4 is a perspective view of the bracket supported on a wire shelf.

FIG. 4 shows the bracket 10 supported on wire shelving 46. Hook portion 22 is easily inserted up between the forward most pair of wires 48 and 50 for hooking onto wire 50 as shown. Such wire shelving is common in retail display freezers and retail refrigeration units for dairy products, for example.

Figure 5:
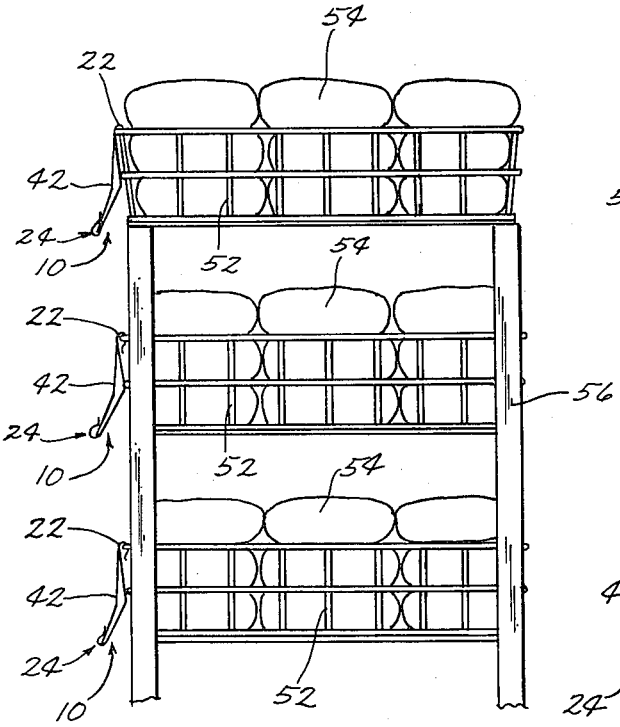
FIG. 5 is a side elevational view of a plurality of brackets supported on freezer baskets.

FIG. 5 shows several brackets 10 hooked onto the upper edge of stacked freezer baskets 52 containing packaged meat products 54 and supported on a rack 56. It is apparent that the brackets are easily placed onto and removed from the baskets and that the tags 42 on the brackets are readily visible without any need for manually grasping and turning them as with conventional wire fastened cardboard tags.

Figure 6:
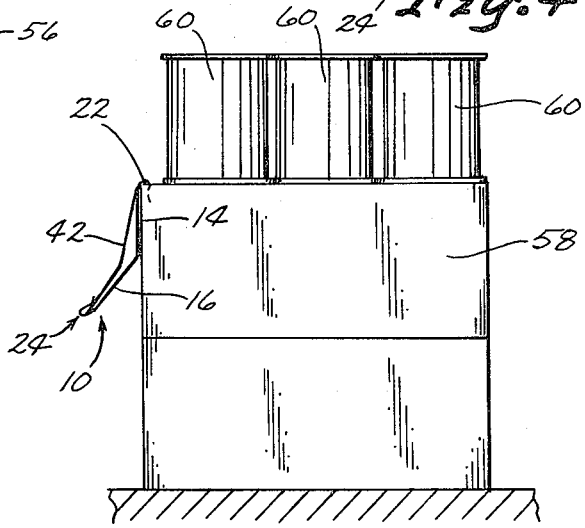
FIG. 6 is a side elevational view of the bracket supported on a side wall of cardboard box.

The versatility of the bracket 10 of the present invention can be seen with reference to FIG. 6 wherein the bracket 10 is engaged over the upper edge of a cardboard box 58 of canned grocery products 60, for example.

Figure 2:
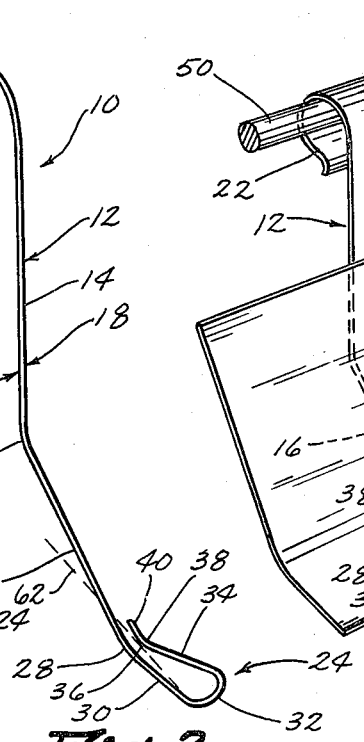
FIG. 2 is a side view of the bracket.

Accordingly, there is provided a simple tag holding bracket which may be most economically formed from a single blank of flat stock and which is operative to support a tag or the like without any spring gripping or pinching of the tag. In explanation of the operativeness of the present invention, reference is made to FIG. 2 wherein it is seen that a dotted line 62 through the lower end of the channel rearward wall 30 and the tag engaging surface 36 of forward wall 34 also intersects base member 12. Preferably, tag engaging surface 36 is positioned relative to channel 24 and lower portion 16 so that line 62 intersects lower portion 16. Accordingly, a tag inserted into channel 24 will necessarily engage the base member and be bent upwardly as at 44 to be securely held therein. The bend 44 in the tag also reinforces the tag itself and prevents bending of the nonsupported ends of the tags.

Whereas a preferred embodiment of the invention has been shown and described herein, it is apparent that many modifications, substitutions and alterations may be made within the intended broad scope of the appended claims. For example, it is not critical that the support means at the top of the bracket be a hook as shown in the preferred embodiment. Likewise, the hook and channel 24 need not be integrally formed with the base member 12. Furthermore, the various portions of the bracket need not be flat as illustrated in the drawings so long as the inclined relation between the channel and lower portion is provided to effect the bending of a tag supported on the bracket. The inclination between the lower portion 16 and upper portion 14 of the base member of course contributes to the improved visibility of a tag supported on the bracket.

Stainless steel is a preferred material for the bracket since it is safe for food processing and handling applications.

Since the tag engaging surface 36 of channel 24 is positioned adjacent to but in spaced relation from both rearward wall 30 and lower portion 16 of the base member, it obviously does not depend upon any spring gripping of the tag for its operation. Use of the term "clip" in describing channel 24 is therefore not intended to imply any such gripping or spring action of the channel.

Thus there has been shown and described a tag holding bracket which accomplishes at least all of its stated objects.

I claim:

1. A bracket for holding and displaying a tag, placard and the like, comprising, an elongated base member having upper and lower ends and forward and rearward sides, support means connected to the upper end of said base member whereby said base member is adapted for suspension from said support means, and clip means connected to the lower end of said base member for supporting a tag thereon, said base member including upper and lower portions and said lower portion being inclined downwardly and forwardly from said upper portion, said clip means comprising a generally open topped U-shaped member including forward and rearward legs, said rearward leg being connected to said lower portion and inclined relative thereto so as to extend forwardly therefrom, the forward leg of said clip means includes a rearwardly facing tag engaging surface adjacent the upper end thereof and said tag engaging surface being positioned relative to said rearward leg and said base member so that a straight line through the lower end of said rearward leg and said tag engaging surface intersects said base member.

2. The bracket of claim 1 wherein said upper and lower portions of said base member are connected together at a first bend about a generally transverse axis across said base member.

3. The bracket of claim 2 wherein said upper and lower portions are substantially flat.

4. The bracket of claim 2 wherein the rearward leg of said clip means comprises an integral extension of said lower portion.

5. The bracket of claim 4 wherein said rearward leg is connected to said lower portion at a second bend about a second generally transverse axis across said base member.

6. The bracket of claim 5 wherein said lower portion of said base member and rearward leg of said clip means are substantially flat.

7. The bracket of claim 1 wherein said rearward leg of said clip means extends forwardly and downwardly from said lower portion.

8. The bracket of claim 1 wherein said support means comprises a hook.

9. The bracket of claim 8 wherein said hook extends rearwardly from said upper end of said base member.

10. The bracket of claim 1 wherein said tag engaging surface is so positioned that a straight line through the lower end of said rearward leg and said tag engaging surface intersects said lower portion of the base member.

11. A tag holding bracket including, an elongated base member having upper and lower ends and forward and rearward sides, support means connected to said base member adjacent the upper end thereof whereby said base member is adapted for suspension from said support means, said base member including upper and lower portions connected together at a first bend about a first axis directed generally transversely of said base member whereby said lower portion extends forwardly from said upper portion, and a generally U-shaped channel connected to said base member adjacent the lower end thereof, said channel including a rearward leg connected to said lower portion and extended downwardly and forwardly therefrom and a forward leg extending upwardly and rearwardly over said rearward leg and including a tag engaging surface so positioned that a straight line through the lower end of said rearward leg and tag engaging surface intersects said base member.

12. The tag holding bracket of claim 11 wherein said tag engaging surface is positioned in spaced relation from and adjacent to the connection between the rearward leg of said channel and said lower portion of the base member.

* * * * *